US008894272B2

(12) United States Patent
Kato

(10) Patent No.: US 8,894,272 B2
(45) Date of Patent: Nov. 25, 2014

(54) POWDER MATERIAL AGITATOR

(75) Inventor: Fumio Kato, Handa (JP)

(73) Assignee: Tsukasa Co., Ltd., Handa-Shi, Aichi (JP)

( * ) Notice: Subject to any disclaimer, the term of this patent is extended or adjusted under 35 U.S.C. 154(b) by 43 days.

(21) Appl. No.: 13/140,432

(22) PCT Filed: Sep. 1, 2010

(86) PCT No.: PCT/JP2010/005396

§ 371 (c)(1),
(2), (4) Date: Jun. 17, 2011

(87) PCT Pub. No.: WO2011/027556

PCT Pub. Date: Mar. 10, 2011

(65) Prior Publication Data

US 2011/0255364 A1 Oct. 20, 2011

(30) Foreign Application Priority Data

Sep. 4, 2009 (JP) ..... 2009-205367

(51) Int. Cl.
*B01F 7/04* (2006.01)
*B01F 3/18* (2006.01)

(Continued)

(52) U.S. Cl.
CPC ... *B01F 7/04* (2013.01); *B01F 3/18* (2013.01); *B01F 7/00133* (2013.01); *B01F 7/00158* (2013.01); *B01F 7/00633* (2013.01); *B01F 7/00708* (2013.01); *B01F 7/08* (2013.01); *B01F 13/0032* (2013.01); *B01F 13/1038* (2013.01); *B01F 15/027* (2013.01); *B01F 15/0289* (2013.01)
USPC ..... 366/330.4; 366/155.1; 366/294; 366/330.1; 366/330.2

(58) Field of Classification Search
CPC ..... B01F 7/043; B01F 15/0202
USPC ..... 366/155.1, 194, 330.1, 330.2, 330.4
See application file for complete search history.

(56) References Cited

U.S. PATENT DOCUMENTS 61,892 A * 2/1867 Sweetland ..... 366/330.1
1,156,606 A * 10/1915 Lawrie ..... 423/123

(Continued)

FOREIGN PATENT DOCUMENTS

DE 32 02 588 A1 8/1983
DE 41 20 895 A1 1/1993

(Continued)

*Primary Examiner* — David Sorkin
*Assistant Examiner* — Abbas Rashid
(74) *Attorney, Agent, or Firm* — Matthias Scholl, PC; Matthias Scholl

(57) ABSTRACT

An agitator 1 has a vessel 4 provided between an upper powder/particulate material supplier 2 and a lower powder/particulate material discharger 3 to hold therein powder/particulate material to be stirred. The agitator 1 also has a stirrer 7 provided in the vessel 4 to have a stirrer rotating shaft 5 arranged in a horizontal direction and main paddles 6 fastened to the rotating shaft 5, and a multi-feeder 8 provided in the powder/particulate material discharger 3 to have both forward rotation and reverse rotation. The multi-feeder 8 has a discharger rotating shaft 81 and small-size auxiliary paddles 9 integrally rotated with the rotating shaft 81 and designed to be smaller in size than the main paddles 6. In the state of stirring the powder/particulate material in the vessel 4 by means of the stirrer 7, the agitator 1 has stirring assist function during reverse rotation of the multi-feeder 8 to cause the auxiliary paddles 9 to stir up the powder/particulate material in the powder/particulate material discharger 3 and feed the powder/particulate material back into the vessel 4. The agitator 1 also has discharge function during forward rotation of the multi-feeder 8 to discharge the powder/particulate material out of the powder/particulate material discharger 3 and the vessel 4. This arrangement effectively prevents the powder/particulate material from being accumulated in any dead space, while reducing the total height of the powder/particulate material discharger of the agitator.

29 Claims, 6 Drawing Sheets

(51) Int. Cl.

| | |
|---|---|
| ***B01F 7/00*** | (2006.01) |
| ***B01F 7/08*** | (2006.01) |
| ***B01F 13/00*** | (2006.01) |
| ***B01F 13/10*** | (2006.01) |
| ***B01F 15/02*** | (2006.01) |

(56) References Cited

U.S. PATENT DOCUMENTS

| | | | | | |
|---|---|---|---|---|---|
| 1,247,153 | A | * | 11/1917 | Roberts | 366/104 |
| 1,477,434 | A | * | 12/1923 | Enright | 222/240 |
| 1,514,118 | A | * | 11/1924 | Wright | 196/46 |
| 1,855,828 | A | * | 4/1932 | Flynn | 366/148 |
| 1,902,733 | A | * | 3/1933 | Smestad | 366/155.1 |
| 2,015,244 | A | * | 9/1935 | Stockdale | 366/309 |
| 2,402,931 | A | * | 6/1946 | Thomas | 62/343 |
| 2,587,127 | A | * | 2/1952 | Erickson et al. | 366/182.2 |
| 3,133,728 | A | * | 5/1964 | Janke | 366/64 |
| 3,181,840 | A | * | 5/1965 | Rietz | 366/311 |
| 3,273,863 | A | * | 9/1966 | Lodige et al. | 366/101 |
| 3,385,528 | A | * | 5/1968 | Schaus | 241/15 |
| 3,450,179 | A | * | 6/1969 | Golding | 241/82.5 |
| 3,515,374 | A | * | 6/1970 | Curley | 366/193 |
| 3,548,903 | A | * | 12/1970 | Holly | 241/82.1 |
| 3,570,569 | A | * | 3/1971 | Hartley et al. | 241/82.6 |
| 3,939,073 | A | * | 2/1976 | Bats | 210/219 |
| 3,984,056 | A | * | 10/1976 | Hartley | 241/82.1 |
| 4,483,625 | A | * | 11/1984 | Fisher | 366/297 |
| 4,583,842 | A | * | 4/1986 | Shimono et al. | 399/256 |
| 4,887,911 | A | * | 12/1989 | Miyaji | 366/316 |
| 5,393,138 | A | * | 2/1995 | Federhen | 366/64 |
| 5,516,009 | A | * | 5/1996 | Kautz | 222/238 |
| 5,607,113 | A | * | 3/1997 | McGuffin et al. | 241/82.1 |
| 5,791,779 | A | * | 8/1998 | Smith, Sr. | 366/297 |
| 5,921,675 | A | * | 7/1999 | Zikeli et al. | 366/186 |
| 7,458,716 | B2 | * | 12/2008 | Kato | 366/329.2 |
| 8,104,703 | B2 | * | 1/2012 | Vila Bonas | 241/101.8 |
| 2005/0058013 | A1 | * | 3/2005 | Warf et al. | 366/98 |
| 2007/0091717 | A1 | * | 4/2007 | Steinwald | 366/141 |
| 2008/0159068 | A1 | | 7/2008 | Kato | |
| 2009/0323465 | A1 | * | 12/2009 | Simonsen | 366/172.1 |
| 2010/0243777 | A1 | * | 9/2010 | Vila Bonas | 241/98 |

FOREIGN PATENT DOCUMENTS

| | | | |
|---|---|---|---|
| JP | 5-86508 | U | 11/1993 |
| JP | 9-238609 | A | 9/1997 |
| JP | 2002-336670 | A | 11/2002 |
| JP | 2003-62551 | A | 3/2003 |
| JP | 2005-58927 | A | 3/2005 |
| JP | 2009-11944 | A | 1/2009 |
| KR | 10-2008-0061226 | A | 7/2008 |

* cited by examiner (a)

(b)

(a)

(b)

POWDER MATERIAL AGITATOR

CROSS-REFERENCE TO RELATED APPLICATIONS

This is a National Stage Application of International Patent Application No. PCT/JP2010/005396, with an international filing date of Sep. 1, 2010, which is based on Japanese Patent Application No. 2009-205367, filed Sep. 4, 2009.

BACKGROUND OF THE INVENTION

1. Technical Field

The present invention relates to a powder/particulate material agitator, and more specifically to a powder/particulate material agitator configured to prevent accumulation of powder/particulate material in any dead space.

2. Background Art

A powder/particulate material blender 1 disclosed in Patent Literature 1 includes a vessel 5 provided to have a powder/particulate material supplier 2 and a powder/particulate material discharger 3 and configured to blend two or more different types of powder/particulate materials by means of paddles 4, a rotary valve 6 connected with the powder/particulate material discharger 3, and a gas-particulate mixture generator 7 configured to mix powder/particulate material discharged from the rotary valve 6 with a gas to generate a gas-particulate mixture. The powder/particulate material blender 1 has a two-way valve 8 provided downstream of the rotary valve 6, a return pipe 9 arranged to connect the gas-particulate mixture generator 7 with the vessel 5 via a return extension pipe 9*a* to return the flow of the gas-particulate mixture into the vessel 5, and a discharge pipe 11 arranged to connect the gas-particulate mixture generator 7 with a downstream gas-particulate mixture transportation line 10. The powder/particulate material blender 1 also has a discharge direction switchover unit 12 to switch over the discharge direction of the transported gas-particulate mixture by means of the rotary valve 6.

The blender 1 further has a gas-particulate separator 13 provided to evacuate the gas from the vessel 5. In the two-way valve 8 at a first position (see FIG. 3(*a*) of Patent Literature 1), the gas-particulate mixture generator 7 communicates with the return pipe 9 to discharge the powder/particulate material blended in the vessel 5 from from the rotary valve 6, return the flow of the gas-particulate mixture through the discharge direction switchover unit 12 into the vessel 5 as shown by an arrow A, and evacuate the gas from the vessel 5 by vessel 4 by means of the gas-particulate separator 13. In the two-way valve 8 at a second position (see FIG. 3(*b*) of Patent Literature 1), the gas-particulate mixture generator 7 communicates with the discharge pipe 11 to discharge the flow of the gas-particulate mixture to the downstream gas-particulate mixture transportation line 10 (see FIG. 4 of Patent Literature 1) as shown by an arrow B. This proposed arrangement aims to prevent the powder/particulate material from remaining in any blending dead space and being incorporated into any powdery product and to reduce the height of the discharger of the blender. This accordingly intends to simultaneously attain the prevention of the contamination and the reduction of the management cost of the blender.

CITATION LIST

Patent Literature

Patent Literature 1: JP 2005-58927

SUMMARY OF THE INVENTION

The blender disclosed in Patent Literature 1 is, however, required to make the return flow of the powder/particulate material from the rotary valve 6 through the two-way valve 8 and the return pipe 9 into the vessel 5. This arrangement makes the structure of the blender rather complicated and increases the overall height of the blender to have difficulty in input of the powder/particulate material. There is also limitation in increasing the efficiency of blending. One alternative structure may provide a gate device between the blender and a screw feeder to eliminate any dead space where the powder/particulate material is not blended. This alternative arrangement, however, makes the structure of the blender rather complicated and increases the overall height of the blender to have difficulty in input of the powder-particulate material. Either of these structures requires time- and labor-consuming cleaning of the blender, the rotary valve, and the gate device.

By taking into account at least part of the issue discussed above, there are requirements for enabling size reduction and simplification of a powder/particulate material agitator and preventing powder/particulate material from being accumulated in any dead space. There is also a requirement for reducing the height of a powder/particulate material discharger of the powder/particulate material agitator, so as to reduce the overall height of the agitator and facilitate the input of the powder/particulate material. There are further requirements for preventing contamination with the remaining powder/particulate material, remarkably reducing the cleaning cost of the agitator, and enhancing the stirring efficiency.

One aspect of the present invention is directed to a powder/particulate material agitator, which includes a vessel provided between a powder/particulate material supplier and a powder/particulate material discharger to hold therein powder/particulate material to be stirred. The powder/particulate material agitator also has a stirrer provided in the vessel to have a stirrer rotating shaft and a main stirring body fastened to the stirrer rotating shaft, and a feeder provided in the powder/particulate material discharger to have a discharger rotating shaft and a discharge feed member fastened to the discharger rotating shaft, the feeder being arranged to have both forward rotation and reverse rotation. A small-size auxiliary stirring body designed to be smaller in size than the main stirring body is provided on the discharger rotating shaft of the feeder. The powder/particulate material agitator has a stirring assist function during reverse rotation of the feeder to stir up the powder/particulate material in the powder/particulate material discharger and feed the powder/particulate material back into the vessel. The powder/particulate material agitator also has a discharge function during forward rotation of the feeder to discharge the powder/particulate material out of the vessel and the powder/particulate material discharger. Any of various blade structures is applicable to the stirrer; for example, a paddle blade, a screw blade, a propeller blade, or a turbine blade.

The feeder is provided as a powder/particulate material feeding device having a plurality of different functions, i.e., the stirring assist function and the discharge function. In the embodiment discussed below, this feeder is called "multi-feeder". The discharge feed member fastened to the rotating shaft may be a screw structure or a paddle structure.

The powder/particulate material agitator may be utilized as a blender of blending two or more different types of powder/particulate materials or as a storage apparatus configured to stir powder/particulate material in a storage vessel and prevent the powder/particulate material from being localized, solidified, or bridged. The batch-type agitation is preferably applied to the powder/particulate material agitator. The powder/particulate material discharger of the powder/particulate material agitator may be connected with a pneumatic transportation apparatus. The pneumatic transportation apparatus may adopt either a pressure-feed pneumatic transportation system or a suction pneumatic transportation system. The feeder does not have air lock function, which is generally given to a rotary valve. In pressure-feed pneumatic conveyance, a rotary valve with the air lock function or another equivalent element is required below the feeder. In suction pneumatic conveyance, however, the air lock function is not required.

The technique of the present invention is applicable to any of high concentration transportation, medium concentration transportation, and low concentration transportation. Here the term "concentration" represents a mixing ratio of the amount of the powder/particulate material to the amount of the gas in the transportation pipe. The variation in setting of the concentration varies the settings of the gas pressure and the transportation speed. These settings are all relative settings and do not have any standard setting criteria. The higher concentration (i.e., the higher mixing ratio of the powder/particulate material) advantageously gives the higher stability of the transportation gas pressure.

In one preferable embodiment of the powder/particulate material agitator, the main stirring body is a large-size main paddle, and the small-size auxiliary stirring body is a small-size auxiliary paddle.

In another preferable embodiment of the powder/particulate material agitator, an inclination angle of the small-size auxiliary paddle attached relative to an axial direction of the discharger rotating shaft is set to be greater than an inclination angle of the large-size main paddle attached relative to an axial direction of the stirrer rotating shaft.

In still another preferable embodiment of the powder/particulate material agitator, the discharge feed member comprises a screw, and the screw is arranged continuously around the discharger rotating shaft along an axial direction of the discharger rotating shaft.

In another preferable embodiment of the powder/particulate material agitator, the discharge feed member comprises a paddle, and a plurality of paddles are arranged sequentially along an axial direction of the discharger rotating shaft.

The aspect of the invention discussed above enables size reduction and simplification of the powder/particulate material agitator to reduce the manufacturing cost. The above aspect of the invention also prevents the powder/particulate material from remaining (being accumulated) in dead space to enhance the stirring efficiency, while reducing the required height for a discharger of the agitator.

DESCRIPTION OF THE EMBODIMENTS

Figure 1:
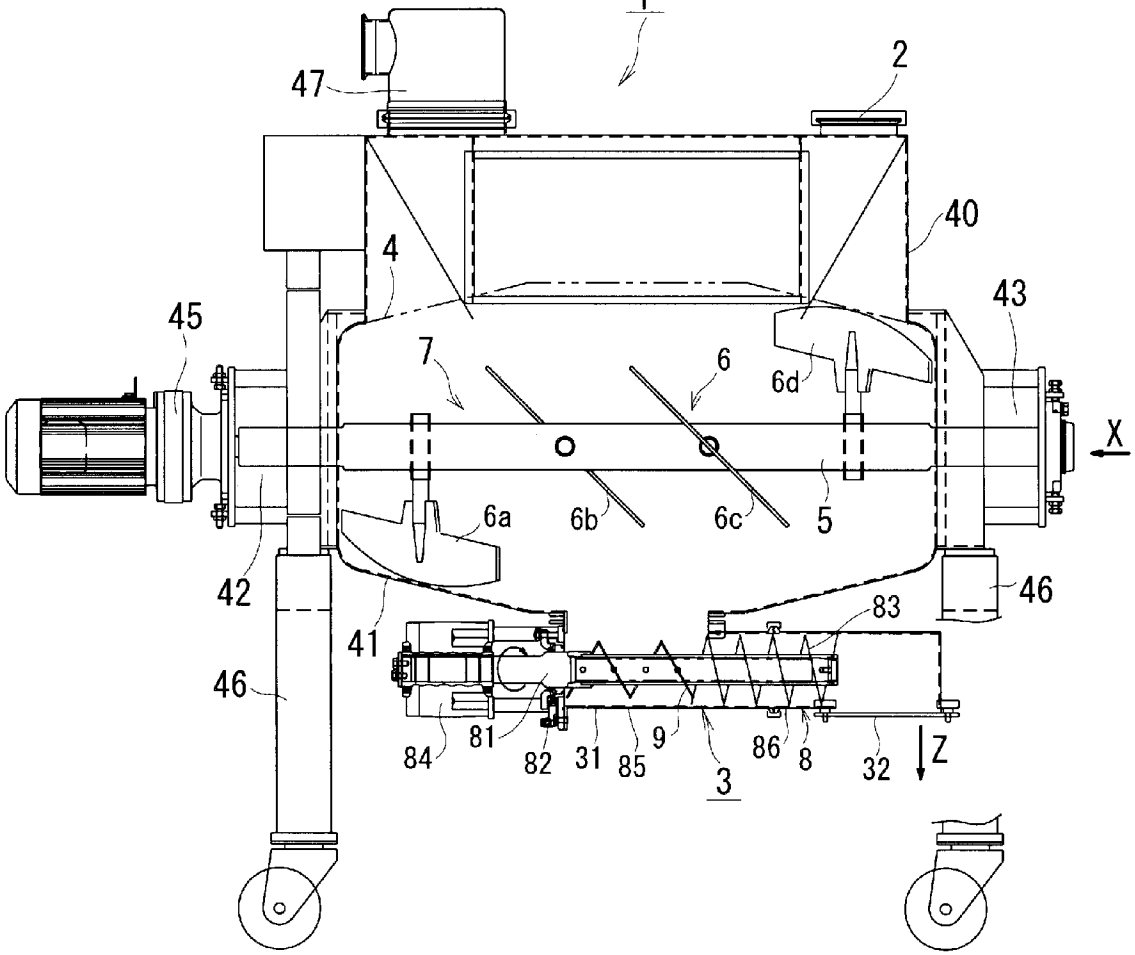
FIG. 1 is a front view of the internal structure of a powder/particulate material agitator in one embodiment of the present invention.

A powder/particulate material agitator 1 in one embodiment of the present invention (hereafter simply referred to as "agitator 1") is described below with reference to FIGS. 1 through 5. The agitator 1 includes a vessel 4 provided between an upper power/particulate material supplier 2 and a lower powder/particulate material discharger 3 to hold therein the powder/particulate material to be stirred, a stirrer 7 provided in the vessel 4 to include a stirrer rotating shaft 5 (hereafter simply referred to as "rotating shaft" 5) arranged in a horizontal direction and main paddles 6 fastened as agitating members to the rotating shaft 5, and a multi-feeder 8 provided in the powder/particulate material discharger 3 to have both forward and reverse rotations. The multi-feeder 8 has a discharger rotating shaft 81 (hereafter simply referred to as "rotating shaft" 81) and auxiliary paddles 9 rotated integrally with the rotating shaft 81 and configured to have smaller dimensions than those of the main paddles 6. The agitator 1 has stirring assist function during reverse rotation of the multi-feeder 8 to cause the auxiliary paddles 9 to stir up the powder/particulate material in the powder/particulate material discharger 3 and feed the powder/particulate material back into the vessel 4. The agitator 1 also has discharge function during forward rotation of the multi-feeder 8 to discharge the powder/particulate material out of the powder/particulate material discharger 3 and the vessel 4. The details of the respective components are discussed below.

Figure 3:
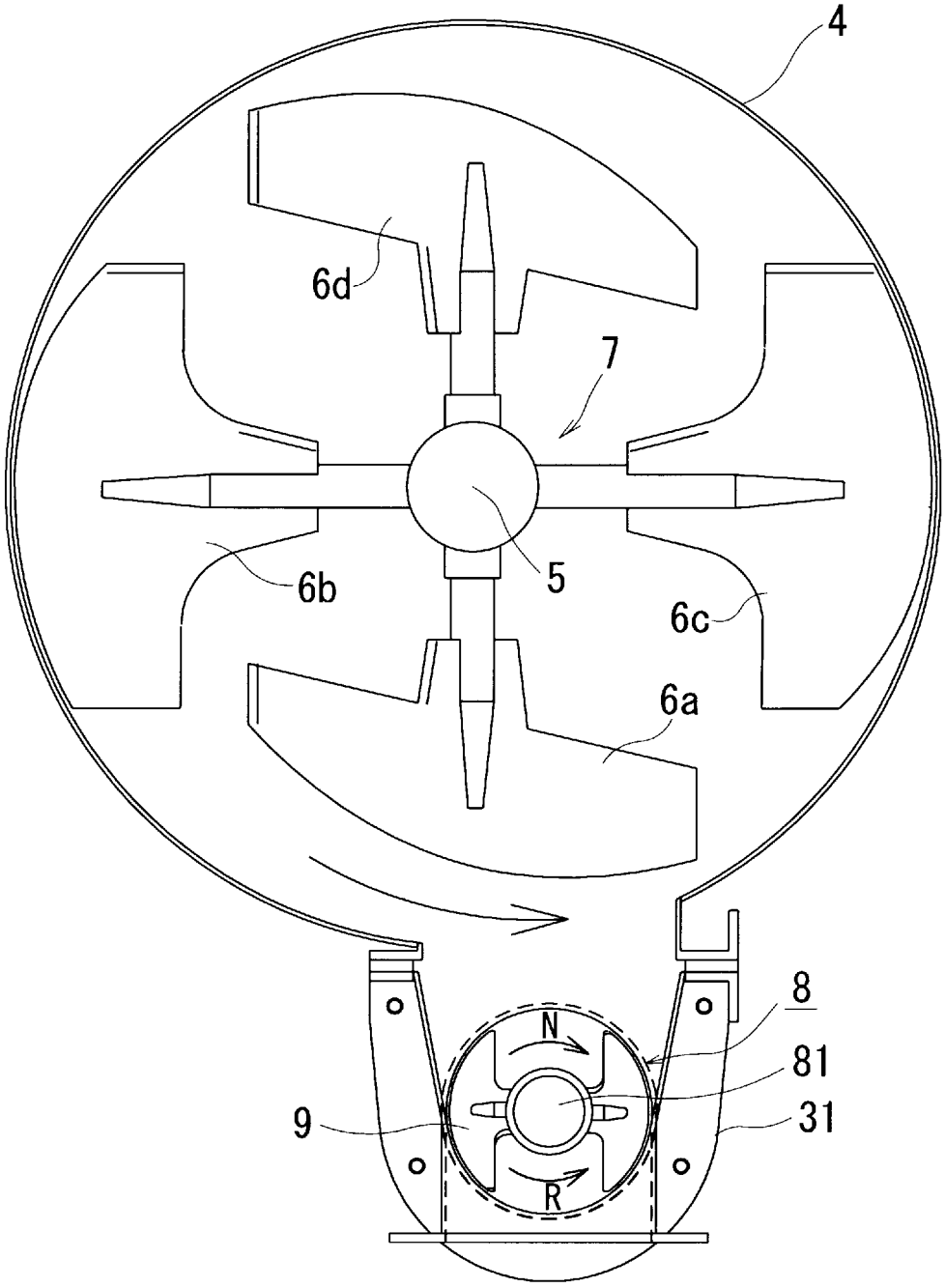
FIG. 3 is a right side view of the internal structure of the powder/particulate material agitator (more specifically, its powder/particulate material discharger seen from an arrow X in FIG. 1)

The powder/particulate material discharger 3 has a discharge casing 31 (hereafter simply referred to as "casing" 31) and an outlet 32 formed on one end of the casing 31. As shown in FIG. 3, the powder/particulate material discharger 3 is provided at a location vertically off-center below the rotating shaft 5. Since the material to be stirred is localized to one side in its rotating direction by the rotational force of the main paddles 6, the powder/particulate material discharger 3 is slightly shifted in the rotating direction to the localized side.

Figure 5:
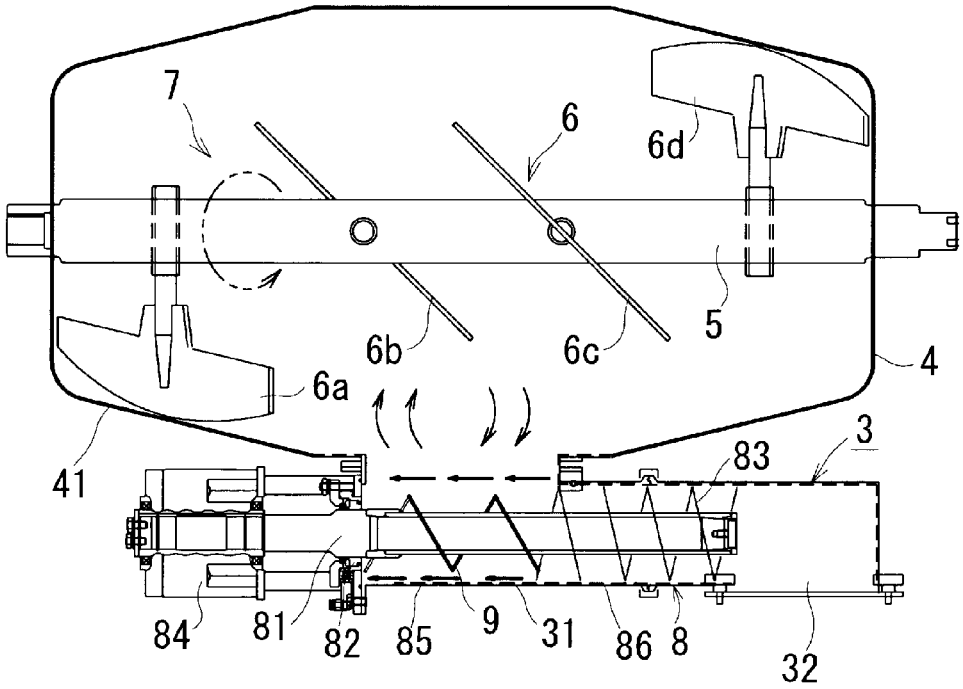
FIGS. 5(*a*) and 5(*b*) are diagrammatic representations of operations of the powder/particulate material agitator.
Figure 5:
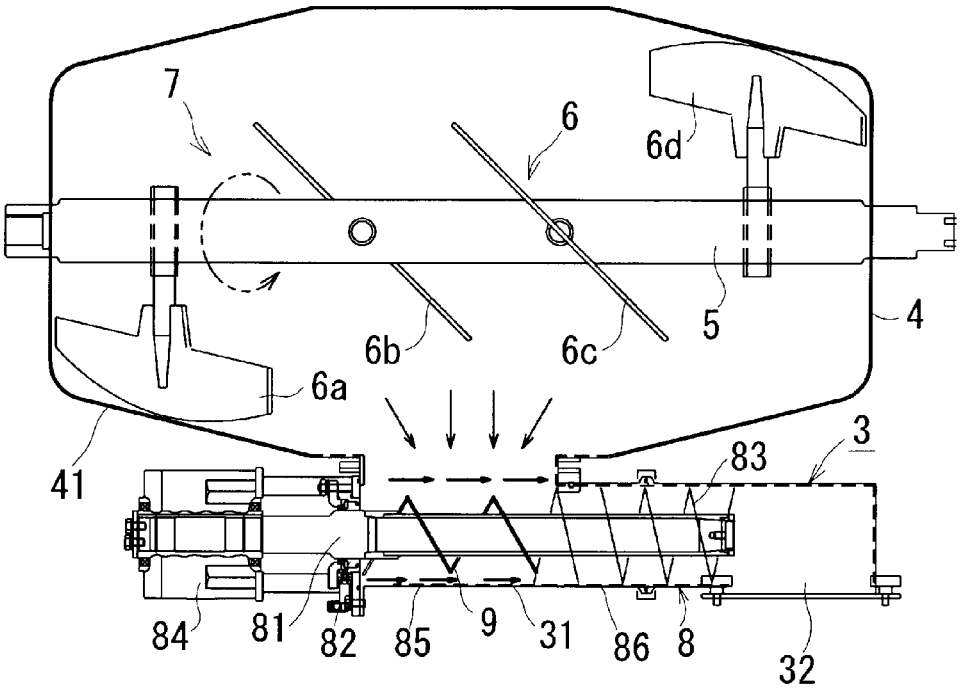

As shown in FIGS. 1 and 5, the vessel 4 has a substantially cylindrical drum with cylindrical side face continually tapered toward both ends to form inclined faces 41. The rotating shaft 5 is held and supported in the horizontal direction in a freely rotatable manner by means of a drive bearing unit 42 and a driven bearing unit 43 provided on the left and right outer centers of the vessel 4. A preset number of the main paddles 6 (in the illustrated example, four main paddles 6*a* through 6*d*) are attached to the outer circumferential face of the rotating shaft 5 to be extended radially from the rotating shaft 5. A drive motor 45 is attached to the outside of the drive bearing unit 42 of the rotating shaft 5 to rotate and drive the rotating shaft 5 with the main paddles 6. The vessel 4 is located inside a main casing 40, which has support legs 46 and an exhaust duct 47. The number and the arrangement of the main paddles 6 may be changed adequately according to the requirements.

Figure 4:
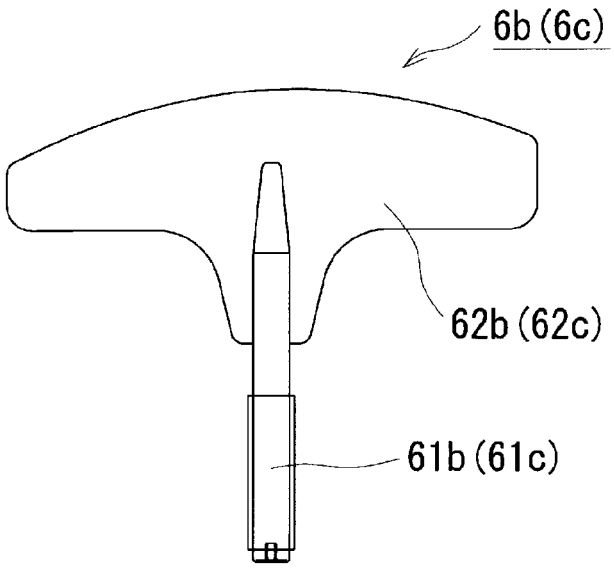
FIGS. 4(*a*) and 4(*b*) are front views of main paddles included in the powder/particulate material agitator.
Figure 4:
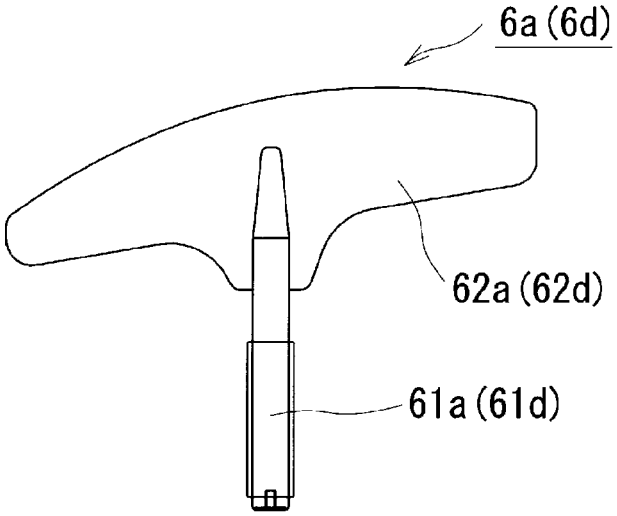

The main paddles 6*a* through 6*d* have shafts 61*a* through 61*d* vertically passing through the side face of the rotating shaft 5 and blades 62*a* through 62*d* formed on respective ends of the shafts 61*a* through 61*d* as shown in FIG. 4. The blades 62*a* through 62*d* are plate-like members protruded both rightward and leftward from the respective ends of the shafts 61*a* through 61*d*. In a preferable application, the end shapes of the blades 62*a* and 62*d* are cut along the inclined faces 41 of the vessel 4 to be different from the end shapes of the other blades 62*b* and 62*c*. FIG. 4(*a*) shows the center pair of main paddles 6*b* and 6*c*, and FIG. 4(*b*) shows the edge pair of main paddles 6*a* and 6*d*.

The main paddles 6*a* through 6*d* are alternately arranged at intervals of a preset angle (for example, 90 degrees) relative to the axial direction of the rotating shaft 5 (see FIG. 3), while being alternately arranged at predetermined intervals along the length of the rotating shaft 5 (see FIGS. 1 and 5). The main paddles 6*a* through 6*d* are arranged, such that both ends of the main faces of the blades 62*a* through 62*d* have certain inclination angles relative to the axial direction of the rotating shaft 5 (e.g., inclination angles of 40 to 60 degrees relative to the axis of rotation).

As shown in FIGS. 1 and 5, the multi-feeder 8 has the rotating shaft 81 arranged in the horizontal direction to be parallel with the rotating shaft 5 in the casing 31, a discharge bearing 82 (hereafter simply referred to as "bearing" 82) provided to support the rotating shaft 81, a screw 83 formed as a discharge feed member on the side close to the outlet 32 on the outer circumferential face of the rotating shaft 81, a drive motor 84 provided to rotate and drive the rotating shaft 81, and the auxiliary paddles 9 having the smaller dimensions than those of the main paddles 6. The casing 31 includes a top-open bottom case 85 having a bottom and having a reverse horseshoe-shaped cross section and a smaller-diameter tubular section 86 coupled with the bottom case 85 to have the smaller diameter than that of the bottom case 85. The screw 83 may have any suitable screw structure, for example, an Archimedean screw as a continuously formed single-winged member.

Figure 2:
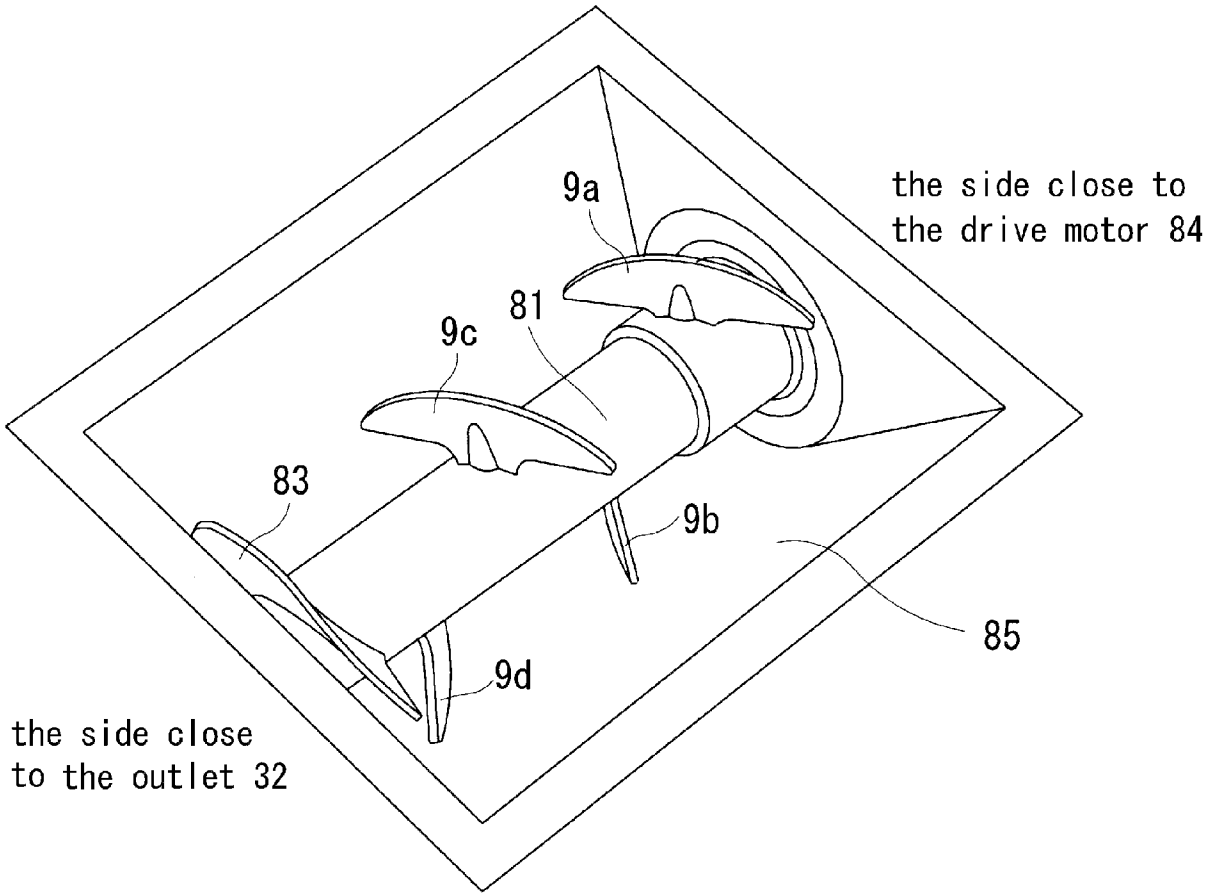
FIG. 2 is a partially-enlarged perspective view of the bottom of the powder/particulate material agitator.

The auxiliary paddles 9 are provided on the center side (i.e., the side farther from the outlet 32) on the outer circumferential face of the rotating shaft 81 with the screw 83 fastened thereto and are rotated integrally with the rotating shaft 81 and the screw 83. A plurality of (four in the illustrated example) of the auxiliary paddles 9 are extended radially. As shown in FIG. 2, the auxiliary paddles 9*a* through 9*d* are arranged, such that both ends of the main faces of their blades have certain inclination angles relative to the axial direction of the rotating shaft 81 (e.g., inclination angles of 50 to 70 degrees relative to the axis of rotation). The inclination angle is not restricted to this angle range. The arrangement of the auxiliary paddles 9*a* through 9*d* is set to stir up the powder/particulate material in their reverse rotations.

The auxiliary paddles 9 have smaller dimensions than those of the main paddles 6. The smaller-size auxiliary paddles 9 are attached at a greater inclination angle relative to the axial direction of the rotating shaft 81 than the inclination angle of the greater-size main paddles 6 attached relative to the axial direction of the rotating shaft 5. This arrangement enables the powder/particulate to be efficiently stirred up in the vessel 4 and enhances the stirring assist function of the agitator 1. The auxiliary paddles 9 formed in the specific shape have stir-up function of diffusing the powder/particulate material in the radial direction of the rotating shaft 81 and feed function of feeding the powder/particulate material in the axial direction of the rotating shaft 81. The screw 83 formed in the specific shape also has the feed function of feeding the powder/particulate material in the axial direction of the rotating shaft 81.

In the state of stirring the powder/particulate material in the vessel 4 by the stirrer 7, the multi-feeder 8 has reverse rotation "R" (counterclockwise rotation in FIG. 3) to stir up the powder/particulate material in the powder/particulate material discharger 3 and feed the powder/particulate material back into the vessel 4. In this state, the powder/particulate material has the motion shown by solid arrows in FIG. 5(*a*). The main paddles 6 stir up the powder/particulate material from the left and right ends toward the center of the vessel 4, so that the flow is preferably made to diffuse the powder/particulate material from the center towards the ends. The reverse rotation R of the screw 83 feeds the powder/particulate material in the powder/particulate material discharger 3 toward the auxiliary paddles 9. In the state of discharging the powder/particulate material out of the powder/particulate material discharger 3 and the vessel 4, on the other hand, the multi-feeder 8 has forward rotation "N" (clockwise rotation in FIG. 3) to feed the powder/particulate material out of the powder/particulate material discharger 3 via the outlet 32 by the auxiliary paddles 9 and the screw 83. In this state, the powder/particulate material has the motion shown by solid arrows in FIG. 5(*b*). The shapes of the auxiliary paddles 9, the directions of their paddle faces, and the arrangement of the auxiliary paddles 9 on the rotating shaft 81 (for example, the locations, the intervals, and the number of the auxiliary paddles 9) are set to achieve such motions of the powder/particulate material. FIGS. 5(*a*) and 5(*b*) conceptually show the flows of the powder/particulate material.

The multi-feeder 8 has the stirring assist function and fixed amount discharge function. These functions of the multi-feeder 8 simplify the structure of the agitator 1 with omission of a flap gate or another gate unit and a rotary valve. This arrangement reduces the total height of the agitator 1 and facilitates the input of the powder/particulate material.

The powder/particulate material discharger 3 may be linked with a gas-particulate mixture generator having an upper end connected with a pneumatic conveyance line. The gas-particulate mixture may be generated by mixing the compressed air supplied from the upstream with the powder/particulate material falling down from the outlet of the multi-feeder 8 and may be discharged downstream. The multi-feeder 8 does not have air lock function, which is generally given to a rotary valve. In pressure-feed pneumatic conveyance, a rotary valve with the air lock function or another equivalent element is required below the multi-feeder 8. In suction pneumatic conveyance, however, the air lock function is not required.

The operations of the agitator 1 of this embodiment are described below. The agitator 1 is applicable to stir any of various powder/particulate materials, such as food material in, for example, a bread plant or a noodle plant. The agitator 1 may be used as a blender for mixing the powder/particulate material.

In the agitator 1 of the embodiment installed in a plant, the material powder input from the powder/particulate material supplier 2 falls down in the vessel 4. Activation of the drive motor 45 starts rotation of the rotating shaft 5 supported by the drive bearing unit 42 and the driven bearing unit 43. The drive motor 84 is also activated to have reverse rotation R (see FIG. 3) and starts reverse rotation R of the rotating shaft 81 supported by the bearing 82. As shown in FIG. 5(*a*), the main paddles 6 inside the vessel 4 are thus rotated to start the stirring operation of the powder/particulate material, while the auxiliary paddles 9 serve to assist stirring. The auxiliary paddles 9 feed the powder/particulate material reverse to the discharge direction in the bottom case 85 and stir up the powder/particulate material into the vessel 4. This gives the upward propulsive force to the powder/particulate material. The reverse motion of the powder/particulate material in the vessel 4 toward the bottom casing 85 preferably attains circulation of the powder/particulate material. This enables the stirring assist function of the main paddles 6 and remarkably enhances the stirring capacity of the agitator 1 for the powder/particulate material. The screw 83 arranged coaxially with the rotating shaft 81 having the auxiliary paddles 9 attached thereto also has reverse rotation to feed the powder/particulate material reverse to the discharge direction (reverse to the direction of the outlet 32). This is equivalent to the gate-closing state to prevent the powder/particulate material from being discharged. The higher rotation speed of the auxiliary paddles 9 leads to the greater upward propulsive force of the powder/particulate material.

For example, on the assumption that approximately half the capacity of the vessel 4 is set as a substantially 100% filling rate, the preferable filling rate of stirring the powder/particulate material is in a range of 20% to 40% as the maximum and minimum about this substantially 100% filling rate. The excessive filling rate causes over-roll, whereas the insufficient filling rate prevents the powder/particulate material from being sufficiently stirred by the main paddles 6. In order to enhance the filling rate, the agitator 1 has a batch arrangement of repeating a series of operations for storing, stirring, and dropping the powder/particulate material.

On completion of the stirring process, the operation of the drive motor 84 is switched over from the reverse rotation R to the forward rotation N (see FIG. 3). This is equivalent to the gate-opening state to feed the powder/particulate material toward the outlet 32. The discharge function is enabled to discharge the powder/particulate material from the outlet 32 in a quantitative manner. In the discharge state, the main paddles 6 are basically rotated to accelerate the discharge of the powder/particulate material. The rotation speeds of the main paddles 6 and the auxiliary paddles 9 may be changed in the stirring state and in the discharge state. For example, the rotation speed of the auxiliary paddles 9 in the stirring state may be set to be higher than the rotation speed in the discharge state.

The agitator 1 of the embodiment has the following effects and advantages:

(1) Since the auxiliary paddles 9 serve to assist stirring of the main paddles 6, the agitator 1 has the enhanced stirring efficiency for the powder/particulate material.

(2) The forward and reverse rotations of the multi-feeder 8 in the powder/particulate material discharger 3 attain the multiple different functions, i.e., the stirring assist function and the discharge function, to attain the size reduction and the simplification of the powder/particulate material discharger 3. The arrangement of the multi-feeder 8 integrally formed with and located vertically below the vessel 4 reduces the total height of the agitator 1 and facilitates the input of the powder/particulate material. The arrangement of the rotary valve directly provided on the powder/particulate material discharger 3 also has the effect of reducing the total height of the agitator 1.

(3) During stirring of the powder/particulate material by the main paddles 6, the reverse rotation of the multi-feeder 8 stirs up the powder/particulate material from the bottom case 85 into the vessel 4. This prevents the powder/particulate material from being accumulated in the bottom case 85 and eliminates the potential dead space (accumulation and mixing failure of the powder/particulate material), thus attaining the stable quality.

(4) Lately, contamination with the remaining powder/particulate material as an allergen has been a problem. The arrangement of the invention effectively eliminates the dead space where the powder/particulate material is accumulated without stirring and thereby prevents contamination of any powdery product with such remaining powder/particulate material accumulated in the dead space without stirring. This arrangement of the invention also facilitates cleaning and reduces the cleaning cost as the measure against the allergy.

Figure 6:
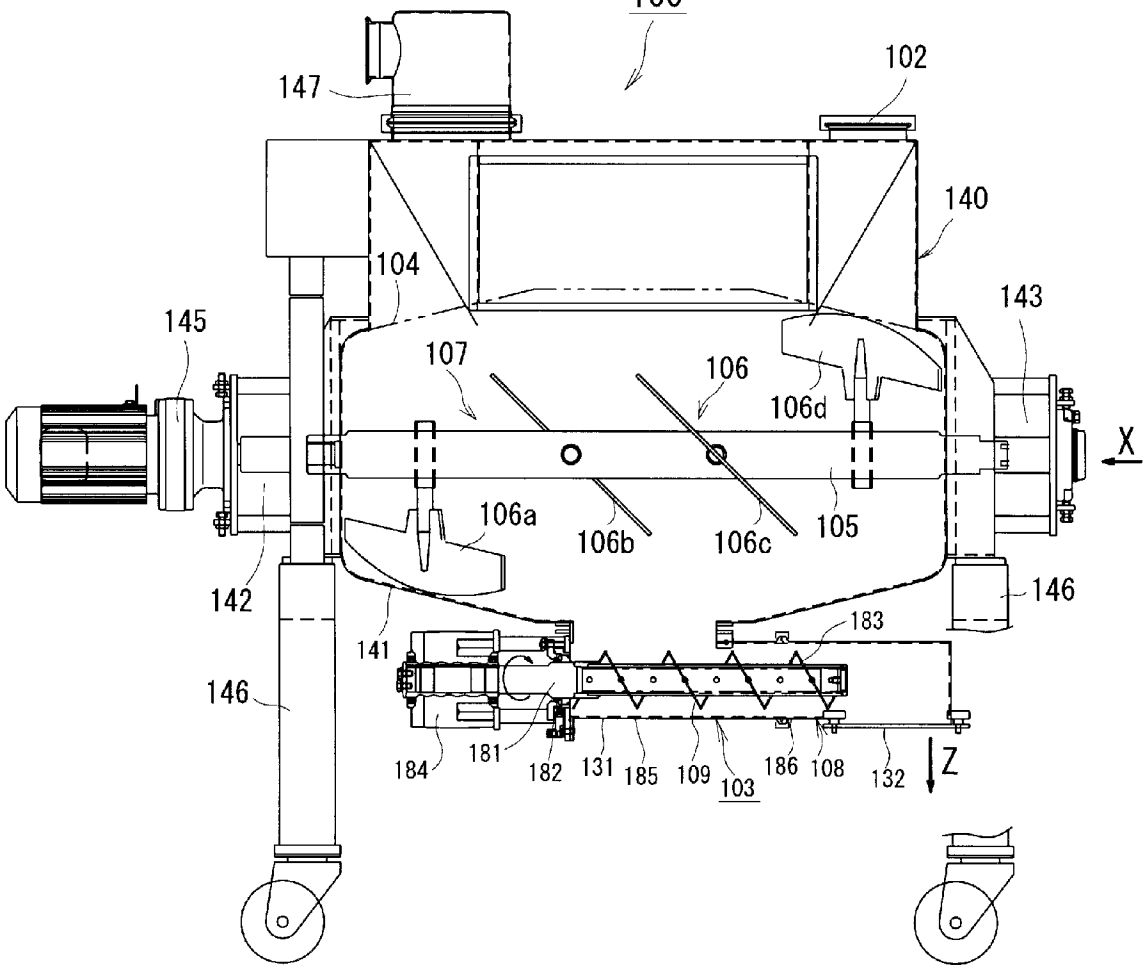
FIG. 6 is a front view of the internal structure of another powder/particulate material agitator in one modification.

Another agitator 100 in one modification of the above embodiment is discussed below with reference to FIG. 6. The agitator 100 has substantially similar structure to that of the agitator 1 of the embodiment. Only the different part from the agitator 1 is described below, while the common parts are not specifically described here. The agitator 100 has a plurality of feed paddles 183 having the same structure as that of the auxiliary paddles 9, in place of the screw 83 of the agitator 1. The auxiliary paddles 109 and the feed paddles 183 feed the powder/particulate material in the same direction, but the auxiliary paddles 109 additionally have the stir-up function of the powder/particulate material.

The above embodiment and its modification are to be considered in all aspects as illustrative for the purpose of better understanding of the invention and not restrictive. There may be many modifications, changes, alterations as well as the equivalency, without departing from the scope or spirit of the main characteristics of the present invention. All such modifications and changes that come within the meaning and range of equivalency of the claims are to be embraced within their scope. The technique of the invention is also applicable to a storage apparatus to stir powder/particulate material in a storage vessel and prevent the powder/particulate material from being localized, solidified, or bridged.

Industrial Applicability

The technique of the present invention is applicable to a blender configured to blend two or more different types of powder/particulate materials, as well as to a storage apparatus configured to stir powder/particulate material in a storage vessel and prevent the powder/particulate material from being localized, solidified, or bridged.

The invention claimed is:

1. A powder material agitator, comprising:

a vessel provided between a powder material supplier and a powder material discharger to hold therein powder material to be stirred;

a stirrer provided in the vessel to have a stirrer rotating shaft and a main stirring body fastened to the stirrer rotating shaft;

a feeder provided in the powder material discharger to have a discharger rotating shaft arranged to be parallel to the stirrer rotating shaft and a discharge feed member fastened to the discharger rotating shaft, the feeder being arranged to have both forward rotation and reverse rotation; and an auxiliary stirring body provided on the discharger rotating shaft; wherein:

the powder material discharger comprises a top-open bottom case and a tubular section;

the tubular section is coupled with the top-open bottom case;

the vessel and the powder material discharger are connected with each other at the top-open bottom case;

the vessel has inclined faces, the inclined faces being inclined downward towards the top-open bottom case;

the auxiliary stirring body is provided in a whole area of the top-open bottom case;

the auxiliary stirring body is smaller in size than the main stirring body; and the powder material agitator has a stirring assist function during reverse rotation of the discharger rotating shaft of the feeder to stir up the powder material in the powder material discharger and to feed the powder material back into the vessel when the stirrer rotating shaft is rotated to stir the powder material in the vessel, and a discharge function during forward rotation of the discharger rotating shaft of the feeder to discharge the powder material out of the vessel and the powder material discharger when the stirrer rotating shaft is rotated to stir and send the powder material in the vessel to the powder material discharger.

2. The powder material agitator of claim 1, wherein the main stirring body is a main paddle, the auxiliary stirring body is an auxiliary paddle, and the auxiliary paddle is smaller in size than the main paddle.

3. The powder material agitator of claim 2, wherein an inclination angle of the auxiliary paddle attached relative to an axial direction of the discharger rotating shaft is set to be greater than an inclination angle of the main paddle attached relative to an axial direction of the stirrer rotating shaft.

4. The powder material agitator of claim 1, wherein the discharge feed member is a screw, and the screw is arranged continuously around the discharger rotating shaft along an axial direction of the discharger rotating shaft.

5. The powder material agitator of claim 1, wherein the discharge feed member comprises a paddle, and a plurality of paddles is arranged sequentially along an axial direction of the discharger rotating shaft.

6. The powder material agitator of claim 2, wherein the discharge feed member is a screw, and the screw is arranged continuously around the discharger rotating shaft along an axial direction of the discharger rotating shaft.

7. The powder material agitator of claim 3, wherein the discharge feed member is a screw, and the screw is arranged continuously around the discharger rotating shaft along an axial direction of the discharger rotating shaft.

8. The powder material agitator of claim 2, wherein the discharge feed member comprises a paddle, and a plurality of paddles is arranged sequentially along an axial direction of the discharger rotating shaft.

9. The powder material agitator of claim 3, wherein the discharge feed member comprises a paddle, and a plurality of paddles is arranged sequentially along an axial direction of the discharger rotating shaft.

10. An agitator for agitating powder material, the agitator comprising:

a vessel;

a powder material supplier;

a powder material discharger;

a stirrer comprising a stirrer rotating shaft and a main stirring body, the main stirring body being disposed on the stirrer rotating shaft, and the stirrer rotating shaft being adapted to be rotated by a first motor;

a feeder comprising a discharger rotating shaft and a discharge feed member, the discharge feed member being disposed on the discharger rotating shaft, and the discharger rotating shaft being adapted to be rotated in a forward direction and in a reverse direction independently from the stirrer rotating shaft by a second motor; and an auxiliary stirring body disposed on the discharger rotating shaft and being smaller in size than the main stirring body; wherein:

the vessel is disposed between the powder material supplier and the powder material discharger;

the vessel is provided to hold the powder material to be stirred;

the powder material discharger comprises a top-open bottom case and a tubular section;

the tubular section is coupled with the top-open bottom case;

the vessel and the powder material discharger are connected with each other at the top-open bottom case;

the vessel has inclined faces, the inclined faces being inclined downward towards the top-open bottom case;

the auxiliary stirring body is provided in a whole area of the top-open bottom case;

the stirrer is disposed in the vessel and is provided to stir the powder material in the vessel;

the stirrer rotating shaft is arranged in a horizontal direction;

the feeder is disposed in the powder material discharger;

the discharger rotating shaft is arranged to be parallel to the stirrer rotating shaft;

when the first motor rotates the stirrer rotating shaft and the second motor rotates the discharger rotating shaft in the reverse direction, the stirrer stirs the powder material in the vessel and the feeder and the auxiliary stirring body stir up the powder material in the powder material discharger and feed the powder material back into the vessel; and when the first motor rotates the stirrer rotating shaft and the second motor rotates the discharger rotating shaft in the forward direction, the stirrer discharges the powder material from the vessel to the powder material discharger and the feeder and the auxiliary stirring body discharge the powder material out of the powder material discharger.

11. The agitator of claim 10, wherein the main stirring body comprises a plurality of main paddles.

12. The agitator of claim 11, wherein the plurality of main paddles comprises paddle shafts and blades, the paddle shafts are arranged vertically with respect to the stirrer rotating shaft, and the blades are disposed on the paddle shafts.

13. The agitator of claim 10, wherein the auxiliary stirring body comprises a plurality of auxiliary paddles, and the discharge feed member is an Archimedean screw.

14. An agitator for agitating powder material, the agitator comprising:

a vessel;

a powder material supplier;

a powder material discharger;

a stirrer comprising a stirrer rotating shaft and a main stirring body, the main stirring body being disposed on the stirrer rotating shaft, and the stirrer rotating shaft being adapted to be rotated by a first motor;

a feeder comprising a discharger rotating shaft and a discharge feed member, the discharge feed member being disposed on the discharger rotating shaft, and the discharger rotating shaft being adapted to be rotated by a second motor in a forward direction and in a reverse direction independently from the stirrer rotating shaft; and an auxiliary stirring body disposed on the discharger rotating shaft, the auxiliary stirring body being smaller in size than the main stirring body; wherein:

the vessel is disposed between the powder material supplier and the powder material discharger;

the stirrer rotating shaft has two ends;

the vessel is provided to hold the powder material to be stirred;

the vessel has a cylindrical drum and two inclined faces;

the cylindrical drum is disposed between the two inclined faces;

the two inclined faces are tapered towards the two ends of the stirrer rotating shaft, respectively;

the stirrer is disposed in the vessel and is provided to stir the powder material in the vessel;

the feeder is disposed in the powder material discharger;

the discharger rotating shaft is parallel to the stirrer rotating shaft;

the discharger rotating shaft is disposed away from a position vertically below the stirrer rotating shaft;

the main stirring body comprises a plurality of main paddles;

the plurality of main paddles comprises two end paddles;

the two end paddles are disposed at the two ends of the stirrer rotating shaft, respectively; and the two end paddles each have an edge, and the two inclined faces are tangent to the two edges, respectively;

when the first motor rotates the stirrer rotating shaft and the second motor rotates the discharger rotating shaft in the reverse direction, the stirrer stirs the powder material in the vessel and the feeder and the auxiliary stirring body stir up the powder material in the powder material discharger and feed the powder material back into the vessel; and when the first motor rotates the stirrer rotating shaft and the second motor rotates the discharger rotating shaft in the forward direction, the stirrer discharges the powder material from the vessel to the powder material discharger and the feeder and the auxiliary stirring body discharge the powder material out of the powder material discharger.

15. The agitator of claim 14, wherein the agitator further comprises a gas-powder mixture generator, and the gas-powder mixture generator is connected to the powder material discharger.

16. The agitator of claim 15, wherein the agitator further comprises a rotary valve, and the rotary valve is connected to the gas-powder mixture generator.

17. A powder material agitator, comprising:

a vessel provided between a powder material supplier and a powder material discharger to hold therein powder material to be stirred;

a stirrer provided in the vessel to have a stirrer rotating shaft and a main stirring body fastened to the stirrer rotating shaft;

a feeder provided in the powder material discharger to have a discharger rotating shaft arranged to be parallel to the stirrer rotating shaft and a discharge feed member fastened to the discharger rotating shaft, the feeder being arranged to have both forward rotation and reverse rotation; and an auxiliary stirring body provided on the discharger rotating shaft; wherein:

the powder material discharger comprises a top-open bottom case and a tubular section;

the tubular section is coupled with the top-open bottom case;

the vessel and the powder material discharger are connected with each other at the top-open bottom case;

the vessel has inclined faces, the inclined faces being inclined downward towards the top-open bottom case;

the auxiliary stirring body is provided in a whole area of the top-open bottom case;

the main stirring body comprises a main paddle, the auxiliary stirring body comprises an auxiliary paddle, and the auxiliary paddle is smaller in size than the main paddle;

the auxiliary paddle is arranged such that a main face of the auxiliary paddle has an inclination angle of from 50 to 70 degrees relative to the axial direction of the discharger rotating shaft; and the powder material agitator has a stirring assist function during reverse rotation of the discharger rotating shaft of the feeder to stir up the powder material in the powder material discharger and to feed the powder material back into the vessel when the stirrer rotating shaft is rotated to stir the powder material in the vessel, and a discharge function during forward rotation of the discharger rotating shaft of the feeder to discharge the powder material out of the vessel and the powder material discharger when the stirrer rotating shaft is rotated to stir and send the powder material in the vessel to the powder material discharger.

18. The powder material agitator of claim 17, wherein an inclination angle of the auxiliary paddle attached relative to an axial direction of the discharger rotating shaft is set to be greater than an inclination angle of the main paddle attached relative to an axial direction of the stirrer rotating shaft.

19. The powder material agitator of claim 17, wherein the discharge feed member is a screw, and the screw is arranged continuously around the discharger rotating shaft along an axial direction of the discharger rotating shaft.

20. The powder material agitator of claim 17, wherein the discharge feed member comprises a paddle, and a plurality of paddles is arranged sequentially along an axial direction of the discharger rotating shaft.

21. The powder material agitator of claim 18, wherein the discharge feed member is a screw, and the screw is arranged continuously around the discharger rotating shaft along an axial direction of the discharger rotating shaft.

22. The powder material agitator of claim 18, wherein the discharge feed member comprises a paddle, and a plurality of paddles is arranged sequentially along an axial direction of the discharger rotating shaft.

23. An agitator for agitating powder material, the agitator comprising:

a vessel;

a powder material supplier;

a powder material discharger;

a stirrer comprising a stirrer rotating shaft and a main stirring body, the main stirring body being disposed on the stirrer rotating shaft, and the stirrer rotating shaft being adapted to be rotated by a first motor;

a feeder comprising a discharger rotating shaft and a discharge feed member, the discharge feed member being disposed on the discharger rotating shaft, and the discharger rotating shaft being adapted to be rotated in a forward direction and in a reverse direction independently from the stirrer rotating shaft by a second motor; and an auxiliary stirring body disposed on the discharger rotating shaft; wherein:

the vessel is disposed between the powder material supplier and the powder material discharger;

the vessel is provided to hold the powder material to be stirred;

the powder material discharger comprises a top-open bottom case and a tubular section;

the tubular section is coupled with the top-open bottom case;

the vessel and the powder material discharger are connected with each other at the top-open bottom case;

the stirrer rotating shaft has two ends;

the vessel has two inclined faces, the two inclined faces being inclined downward towards the top-open bottom case and upward towards the two ends of the stirrer rotating shaft respectively;

the auxiliary stirring body is provided in a whole area of the top-open bottom case;

the stirrer is disposed in the vessel and is provided to stir the powder material in the vessel;

the stirrer rotating shaft is arranged in a horizontal direction;

the feeder is disposed in the powder material discharger;

the discharger rotating shaft is arranged to be parallel to the stirrer rotating shaft;

the main stirring body comprises a main paddle, the auxiliary stirring body comprises an auxiliary paddle, and the auxiliary paddle is smaller in size than the main paddle;

the auxiliary paddle is arranged such that a main face of the auxiliary paddle has an inclination angle of from 50 to 70 degrees relative to the axial direction of the discharger rotating shaft;

when the first motor rotates the stirrer rotating shaft and the second motor rotates the discharger rotating shaft in the reverse direction, the stirrer stirs the powder material in the vessel and the feeder and the auxiliary stirring body stir up the powder material in the powder material discharger and feed the powder material back into the vessel; and when the first motor rotates the stirrer rotating shaft and the second motor rotates the discharger rotating shaft in the forward direction, the stirrer discharges the powder material from the vessel to the powder material discharger and the feeder and the auxiliary stirring body discharge the powder material out of the powder material discharger.

24. The agitator of claim 23, wherein the main stirring body comprises a plurality of main paddles.

25. The agitator of claim 24, wherein the plurality of main paddles comprises paddle shafts and blades, the paddle shafts are arranged vertically with respect to the stirrer rotating shaft, and the blades are disposed on the paddle shafts.

26. The agitator of claim 23, wherein the auxiliary stirring body comprises a plurality of auxiliary paddles, and the discharge feed member is an Archimedean screw.

27. An agitator for agitating powder material, the agitator comprising:

a vessel;

a powder material supplier;

a powder material discharger;

a stirrer comprising a stirrer rotating shaft and a main stirring body, the main stirring body being disposed on the stirrer rotating shaft, and the stirrer rotating shaft being adapted to be rotated by a first motor;

a feeder comprising a discharger rotating shaft and a discharge feed member, the discharge feed member being disposed on the discharger rotating shaft, and the discharger rotating shaft being adapted to be rotated by a second motor in a forward direction and in a reverse direction independently from the stirrer rotating shaft; and an auxiliary stirring body disposed on the discharger rotating shaft, the auxiliary stirring body being smaller in size than the main stirring body; wherein:

the auxiliary stirring body comprises an auxiliary paddle, and the auxiliary paddle is arranged such that a main face of the auxiliary paddle has an inclination angle of from 50 to 70 degrees relative to the axial direction of the discharger rotating shaft;

the vessel is disposed between the powder material supplier and the powder material discharger;

the stirrer rotating shaft has two ends;

the vessel is provided to hold the powder material to be stirred;

the vessel has a cylindrical drum and two inclined faces;

the cylindrical drum is disposed between the two inclined faces;

the two inclined faces are tapered downward towards the top-open bottom case and upward towards the two ends of the stirrer rotating shaft, respectively;

the stirrer is disposed in the vessel and is provided to stir the powder material in the vessel;

the feeder is disposed in the powder material discharger;

the discharger rotating shaft is parallel to the stirrer rotating shaft;

the discharger rotating shaft is disposed away from a position vertically below the stirrer rotating shaft in a rotating direction of the stirrer rotating shaft;

the main stirring body comprises a plurality of main paddles;

the plurality of main paddles comprises two end paddles;

the two end paddles are disposed at the two ends of the stirrer rotating shaft, respectively; and the two end paddles each have an edge, and the two inclined faces are tangent to the two edges, respectively;

when the first motor rotates the stirrer rotating shaft and the second motor rotates the discharger rotating shaft in the reverse direction, the stirrer stirs the powder material in the vessel and the feeder and the auxiliary stirring body stir up the powder material in the powder material discharger and feed the powder material back into the vessel; and when the first motor rotates the stirrer rotating shaft and the second motor rotates the discharger rotating shaft in the forward direction, the stirrer discharges the powder material from the vessel to the powder material discharger and the feeder and the auxiliary stirring body discharge the powder material out of the powder material discharger.

28. The agitator of claim 27, wherein the agitator further comprises a gas-powder mixture generator, and the gas-powder mixture generator is connected to the powder material discharger.

29. The agitator of claim 28, wherein the agitator further comprises a rotary valve, and the rotary valve is connected to the gas-powder mixture generator.

* * * * *